US007322879B2

(12) United States Patent
Meroz

(10) Patent No.: US 7,322,879 B2
(45) Date of Patent: Jan. 29, 2008

(54) REPROFILING DEVICE FOR THE RAILS OF RAILROADS THAT CAPTURES WASTE

(75) Inventor: Jean-Jacques Meroz, Chavannes-des Bois (CH)

(73) Assignee: Speno International S.A., Geneva (CH)

( * ) Notice: Subject to any disclaimer, the term of this patent is extended or adjusted under 35 U.S.C. 154(b) by 0 days.

(21) Appl. No.: 11/520,711

(22) Filed: Sep. 14, 2006

(65) Prior Publication Data

US 2007/0066193 A1 Mar. 22, 2007

(30) Foreign Application Priority Data

Sep. 16, 2005 (CH) ..... 01521/05

(51) Int. Cl.
*B24B 23/00* (2006.01)

(52) U.S. Cl. ..... 451/347; 451/429

(58) Field of Classification Search ..... 451/56–58, 451/178, 437, 69, 182, 347; 51/178, 273; 409/296, 298, 175

See application file for complete search history.

(56) References Cited

U.S. PATENT DOCUMENTS 3,096,933 A * 7/1963 Bora ..... 417/247
3,525,183 A * 8/1970 Gargrave ..... 451/453
4,523,411 A * 6/1985 Freerks ..... 451/357
4,583,327 A * 4/1986 Jaeggi ..... 451/347
5,111,624 A * 5/1992 Shoenhair et al. ..... 451/347
5,549,505 A * 8/1996 Jaeggi ..... 451/69
5,566,437 A * 10/1996 Jaeggi ..... 29/33 R
5,941,766 A 8/1999 Iversen
5,997,391 A * 12/1999 Jaeggi ..... 451/429
6,638,138 B1 * 10/2003 Luddeneit et al. ..... 451/5
6,719,616 B2 * 4/2004 Mathison et al. ..... 451/58
6,805,621 B2 * 10/2004 Hertelendi et al. ..... 451/347
6,921,319 B2 * 7/2005 Knoll et al. ..... 451/56

FOREIGN PATENT DOCUMENTS

| | | |
|---|---|---|
| CH | 671595 | 12/1978 |
| DE | 44 37 541 | 5/1996 |
| JP | 56 044517 | 4/1981 |
| JP | 58 020219 | 2/1983 |
| JP | 08 323624 | 12/1996 |
| JP | 10 201680 | 8/1998 |

* cited by examiner

*Primary Examiner*—Joseph J. Hail, III
*Assistant Examiner*—Anthony Ojini
(74) *Attorney, Agent, or Firm*—Young & Thompson

(57) ABSTRACT

A device for the continuous reprofiling of the rails of railroads includes at least one abrasive rail reprofiling unit (2) guided along the railroad tracks and comprising at least one abrasive disk (3) that can be pressed against a rail (1). This device notably includes at least one abrasive-waste pickup (20) having at least one segment forming a collection port (21). This segment is placed in the immediate vicinity of at least one abrasive disk (3) and into the geometric axis (41) of the major waste jet (40) produced during operation of this abrasive disk (3). The segment (21) simultaneously cooperates with means for transporting the waste. Moreover, each waste pickup (20) includes elements for reflecting and absorbing the kinetic and thermal energy that allow the formation of agglomerations of matter on the pickup to be avoided.

15 Claims, 3 Drawing Sheets

REPROFILING DEVICE FOR THE RAILS OF RAILROADS THAT CAPTURES WASTE

FIELD OF THE INVENTION

The present invention concerns a device for continuously reprofiling the rails of railroads, including at least one abrasive rail reprofiling unit that is guided along a railroad track and comprises at least one abrasive disk that can be pressed against the rails.

BACKGROUND OF THE INVENTION

In the context of rectifying the rails of a track, several methods such as abrading, cutting, planing and other processes have been known for a long time. One of the methods currently preferred is the abrasive reprofiling of the heads of rails, since it is fast and allows important quantities of metal to be removed. The reprofiling units usually are mounted on a railroad vehicle comprising abrading units equipped with abrasive disks rotated and pressed against the pertinent surface of the head of the rail to be rectified. The railroad vehicle moves along the rails of the railroad tracks to be rectified while making the best possible use of the time intervals that are available in view of the more and more intense use of rail networks.

Because of the limited length of time available to do the rectifying work, and hence the significant power of current abrading units, as well as the quality requirements for the rectifications needed, more particularly for high-speed railroad networks or networks intended for very heavy freight trains, the amounts of matter removed during a rectifying operation are very large. This is the reason why it becomes ever more important to recover the abrasive waste produced during a rectifying operation on the rails.

The abrasive waste actually consists for the most part of metal particles from the material taken off the rail surface, and for a small part of abrasive particles from the abrasive disk. The individual masses of these particles extend over a rather large range, as one has on the one hand a dust cloud consisting of particles of small mass, and on the other hand a spark jet rather well concentrated along a particular trajectory and consisting for the larger part of glowing chips having a larger mass, and notably a very high kinetic and thermal energy.

With the aim of recuperating the waste created during abrasive rail reprofiling, a device exists that comprises a box kept under reduced pressure. The box covers the top of the abrading unit and surrounds it on the sides. As described in detail in the Swiss Patent brochure CH 671,595, this device is able on the one hand to suck up from above the dust cloud consisting of particles of small mass and to transport them toward a container on the railroad vehicle in order to keep them there temporarily until they are unloaded. The lateral walls of the device on the other hand form a kind of mechanical collector possibly equipped with a deflector accumulating the heavy particles ejected with the spark jet. Because of their very high kinetic and thermal energy, these heavy particles cannot be sucked up by this device, and rapidly form accumulations of matter on the lateral walls of the box. They thus are not transported to the container in order to be effectively eliminated, but are simply dumped along the railroad track at certain time intervals.

Since the low-mass particles contained in the dust cloud sucked up by this device constitute only 10 to 20% of the abrasive waste while the remainder of the waste matter is contained in the jet of the heavy spark particles, this process does not allow a satisfactory percentage of the waste generated during abrasive rail reprofiling to be recovered. The resulting ecological disadvantage is increasingly important owing to the rising amount of waste produced during reprofiling, as explained above, as well as owing to the fact that the protection of nature in general becomes ever more important. The spark jet moreover has other negative consequences, such as an important release of heat leading to difficult working conditions for the staff in charge of the device and to a high thermal load on the components of the device. The spark jet even represents a risk of injury to the operators, and it would be desirable to eliminate this source of danger.

OBJECT OF THE INVENTION

It is the aim of the present invention to obviate the disadvantages cited, and to make it possible to eliminate all of the abrasive waste generated by abrasive rail rectifications of the railways, to improve the environmental compatibility of rail rectification, and eliminate at least in part the spark jet representing a source of danger for the staff in charge of the reprofiling device, as well as being the reason for high thermal loads on the components of the device.

SUMMARY OF THE INVENTION

This device more particularly includes at least one pickup for the abrasive waste that comprises at least one segment forming a collection port, said segment being placed in the immediate vicinity of at least one abrasive disk and into the geometric axis of the major jet of waste produced during operation of this abrasive disk, this segment cooperating at the same time with the waste transport means. Then not only the particles of small mass but equally well the heavy particles contained in the spark jet are recuperated and then transported to a container so as to be properly disposed of. Thus, removal of nearly the total amount of abrasive waste generated by abrasive rectification of the rails of railroads is possible, and the environmental compatibility of rail rectification is improved. At the same time a source of danger for the staff in charge of the reprofiling device is eliminated, and components of the device other than the abrasive disk and the waste pickup are much less stressed thermally.

Moreover, each waste pickup of the device more particularly comprises means for reflecting and absorbing the kinetic and thermal energy. In this way one can avoid the formation of agglomerated matter on said pickup, and in particular on the inside walls of the pickup or collection port, which is necessary for being able to subsequently transport the waste toward the container.

These elements have a specific shape and consist of a material adapted to avoid the formation of agglomerations of matter on its surface. To this end they are more specifically provided with a ceramic cladding. They may as well have a cooling system, and/or vibrators may be provided to prevent waste from clinging to the pickup.

In addition, the relative positions of an abrasive disk of the reprofiling unit and the collection port of an abrasive-waste pickup may be variable.

This arrangement of the relative positions can be obtained by making the segment that constitutes the collection port of an abrasive-waste pickup move as a function of the position of the abrasive disk in a reprofiling unit. It may be realized as well by an appropriate manipulation of the geometric axis of the major waste jet produced by the operation of an abrasive disk of the reprofiling unit or by a combination of these two measures.

Whatever the mode of operation selected to modify the relative positions of abrasive disk and collection port, the purpose will always be the same, viz., that the geometric axis of the major waste jet produced by operation of this disk essentially fall into the geometric center of the corresponding collection port, in such a way that almost all of the matter of a spark jet be recovered and then transported toward the container. By these measures it is possible on the one hand to enhance the efficiency of the device with respect to the percentage of waste eliminated, and on the other hand optimize the layout of the device in view of the rather limited space.

BRIEF DESCRIPTION OF THE DRAWINGS

Further advantages will become evident from the characteristics expressed in the dependent claims and from the description that hereinafter will present the invention in greater details with the aid of drawings.

The annexed drawings illustrate schematically and by way of example one embodiment of a reprofiling device according to the invention.

DETAILED DESCRIPTION OF THE INVENTION

Figure 1:
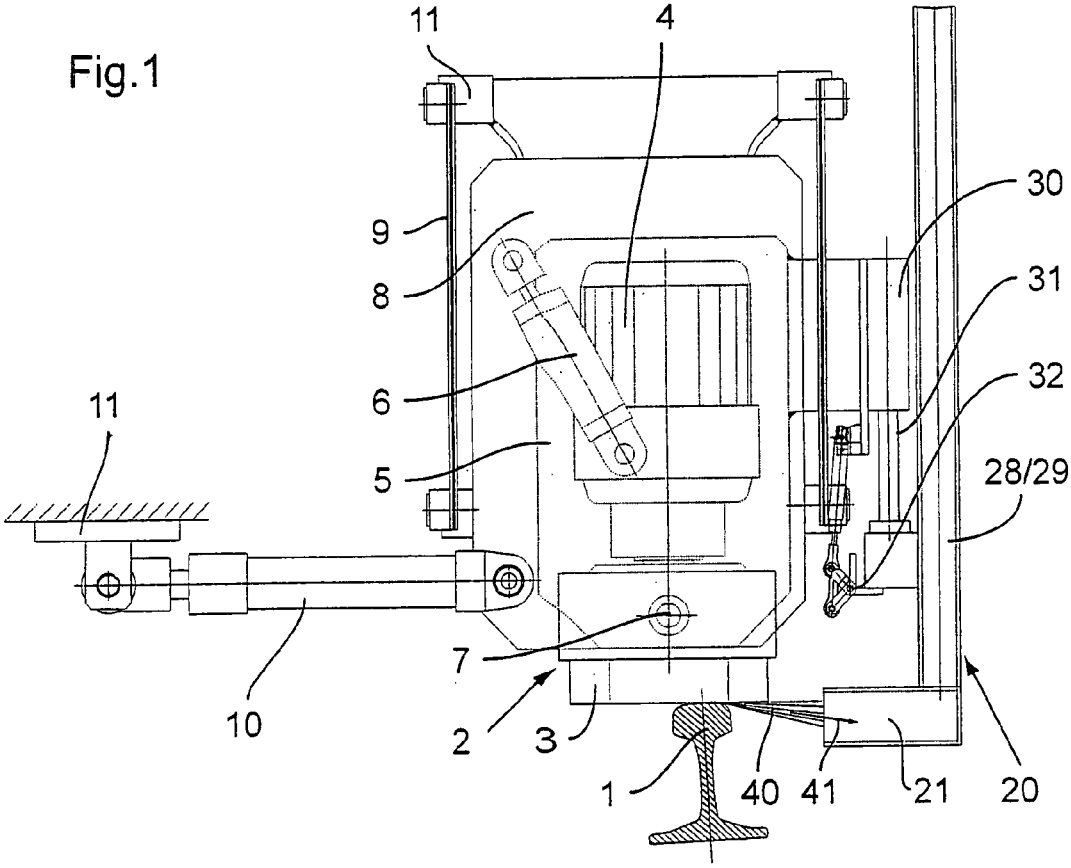
FIG. 1 schematically shows the principle of an abrasive reprofiling device as seen parallel to the rails, and comprising an abrasive reprofiling unit as well as an abrasive-waste pickup having a segment that forms a collection port.

The invention will now be described in detail while referring to the drawings mentioned above, which by way of example illustrate an embodiment of the invention.

Figure 2:
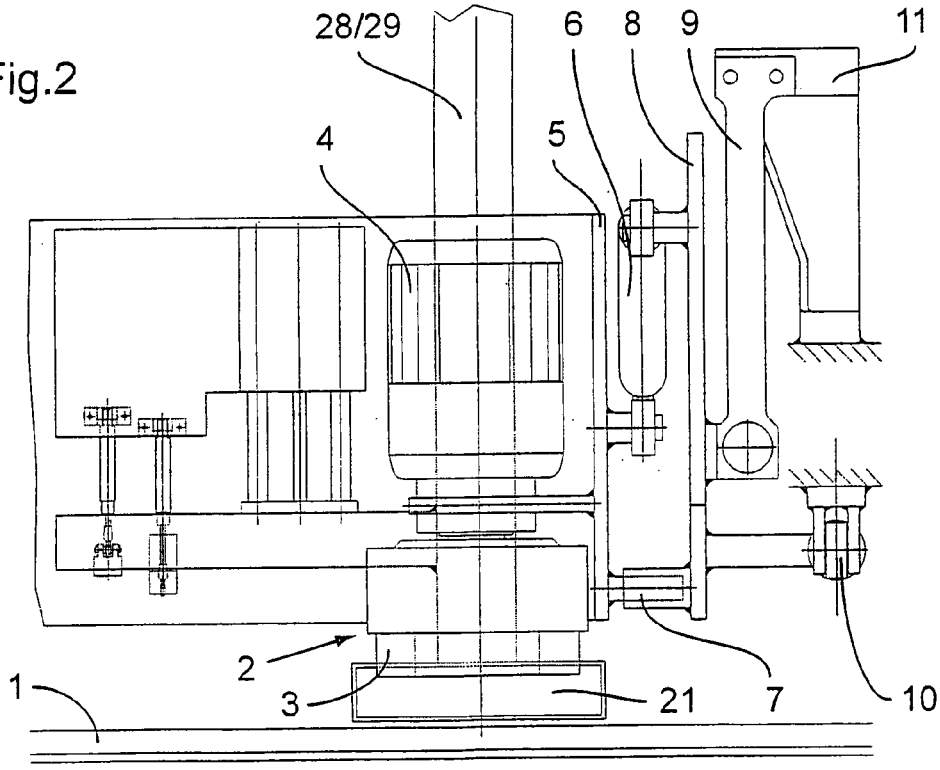
FIG. 2 is a view perpendicular to the rail showing the different components of the device and an example of their assembly, as well as the means allowing one to position the rack holding the abrasive reprofiling unit.

The principle of the device for the continuous reprofiling of the rails of railroad tracks according to the present invention is schematically illustrated in FIG. 1 by a view of the device along the axis of rail 1, where for reasons of simplicity certain segments of the device have not been represented, and in FIG. 2 by a view perpendicular to rail 1 from the inside of the railroad tracks. The device comprises at last one unit 2 for abrasive rail reprofiling. This unit 2 is guided along the railroad tracks, and comprises at least one abrasive disk 3 that can be pressed against the rails 1. The device also includes at least one abrasive-waste pickup 20 comprising at least one segment 21 forming a collection port. This segment 21 is set up in the immediate vicinity of at least one abrasive disk 3, and in the geometric axis 41 of the major waste jet 40 produced during operation of this abrasive disk 3. This segment 21 simultaneously cooperates with the means for transporting the waste. The major waste jet 40 mainly consists of the sparks ejected with a very high kinetic and thermal energy.

In the embodiment presented in the figures, these components are mounted on a railroad vehicle as follows. First the railroad vehicle comprises a fixed segment serving as support 11 for the device. Spring blades 9 are fixed at one of their ends to this support 11, and with their other ends two by two hold two plates 8 which are mutually parallel, and essentially orthogonal to the direction of rails 1. A jack 10 may act orthogonally relative to the direction of the rails 1, and essentially parallel to the plane of the railroad tracks, upon each of these plates 8 so as to make these two plates 8 simultaneously come closer to the rails 1, or move away from the rails 1, in a lateral direction by virtue of the elasticity of spring blades 9. The utility of this function will be explained in detail further down in the text. Between the plates 8 there is a rack 5 that is fixed to these plates 8 in such a way that it can swivel about points of rotation or the axis of rotation 7 that is essentially parallel to rails 1. The rack 5 holds at least one abrasive disk 3 as well as a drive motor 4 and the controls for the disk 3. This set of components forms an abrasive reprofiling unit 2 which in the following will simply be called an abrading unit 2. Jacks 6 are mounted on each side of rack 5 between one plate and the side wall of rack 5, so that this rack as well as the disk or disks 3 may be tilted, and thus oriented relative to a particular surface on the rail 1 to be rectified. It will evidently be possible to equip each rack 5 with several disks 3 and/or put several racks 5 with a single disk 3 (or with several disks) on support 11, so that the abrading units 2 actually may have a variable makeup. For reasons of simplicity only the embodiment having one abrasive disk 3 per abrading unit 2 will be described in detail in what follows.

The abrasive-waste pickup 20 is also mounted on rack 5, in such a way that the segment 21 forming a collection port that is set up facing the abrasive disk 3 will basically follow the movements of the corresponding abrading unit 2 that are executed in order to remove matter from the surface of the particular rail, so that an optimum rectification result may be obtained. For this reason the largest part of the matter of spark jet 40 automatically flies into the collection port that is set up where the waste escapes, that is, at the source of the waste, which thus is collected directly at the site of its generation. By referring to FIG. 3, the pickup 20 and more particularly the segment 21 forming a collection port will in the following be described in greater detail.

Owing to the very high kinetic and thermal energy of the sparks, each waste pickup 20 firstly comprises means for reflection and absorption making it possible to avoid the formation of agglomerations of matter on said pickup, and to be able to subsequently suck away the waste.

Figure 3:
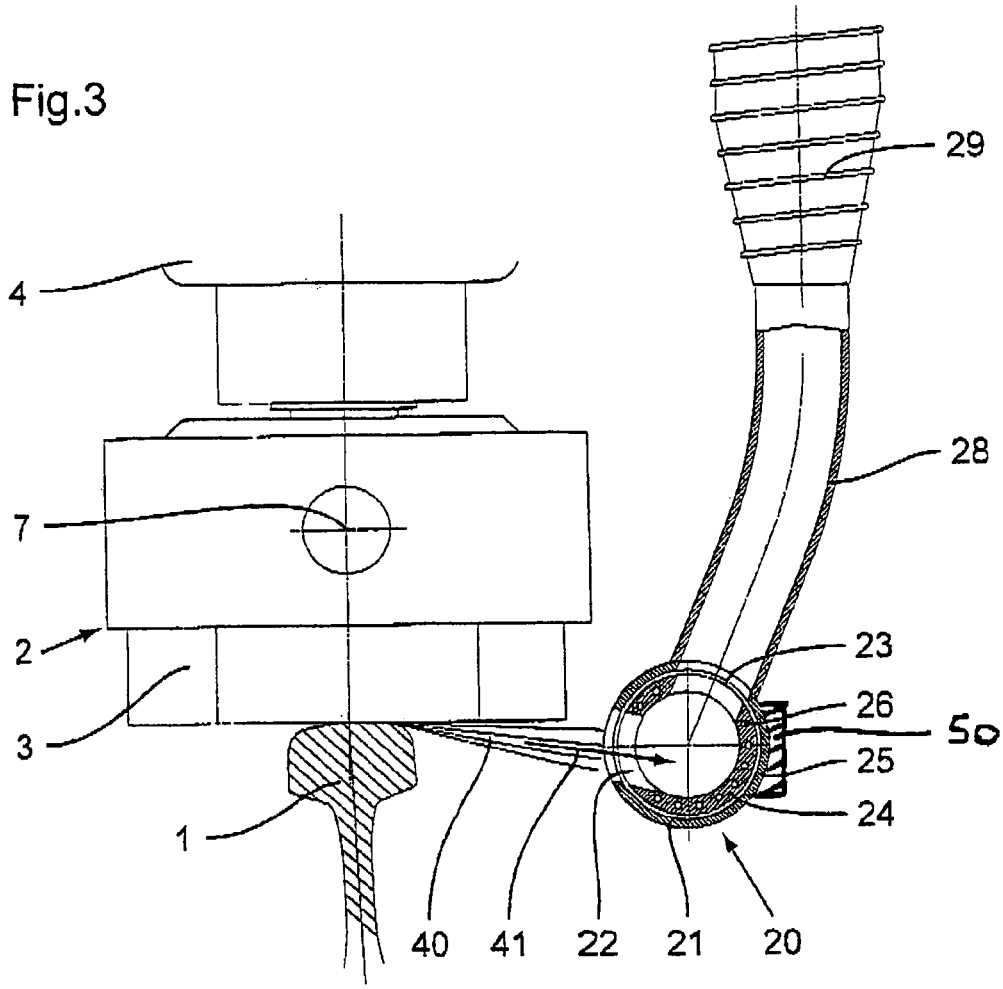
FIG. 3 is a schematic sectional view representing in greater detail an abrasive reprofiling unit with the abrasive-waste pickup positioned in the geometric axis of the major waste jet produced during operation of the abrasive disk.

A first measure concerning these means for reflecting and absorbing the kinetic and thermal energy consists in coating at least part of the inner walls of the waste pickup 20 by a material adapted to avoid the formation of agglomerations of matter on its surface. As shown in FIG. 3, this may for instance be achieved by realizing the segment 21 forming the collection port, as an outer structure 25 in steel sheathed with an inner structure 24 consisting of a special material. This material is for instance a ceramic material, preferably of the type of silicium carbide (SiC). Contrary to steel, it is possible with the ceramic material to recover the glowing chips of the spark jet while effectively avoiding the formation of agglomerations of matter on the surfaces of the inner walls of collection port 21, which is of prime importance in order to avoid a blocking of entrance 22 of the pickup 20, and to subsequently transport this matter toward the container.

Apart from the material used for the waste pickup 20, and particularly for the collection port 21, it is above all the shape of these parts that is important for the same reasons as cited above. The means for reflecting and absorbing the kinetic and thermal energy thus include at least one part having a smooth shape adapted to avoid the formation of agglomerations of matter on its surface. In this shape, ridges or obstacles in the pathway of the sparks entering the collection port 21 with a very high energy are avoided, so that the collection port 21 will not have any spot that could provoke an agglomeration of matter. Preferably, the cladding of the inner walls of the waste pickup 20 and the means for reflecting and absorbing the kinetic and thermal energy generally have a shape of rounded cross section while the outer structure 25 in steel and the inner structure 24 are tubular. Otherwise, a waste pickup 20 having a rectangular cross section could evidently be provided with an inner cladding that is rounded and smooth, above all in its corners.

Moreover, segment 21 forming the collection port is provided with an entrance 22 and an exit 23 of specific shape. The entrance 22 receiving the spark jet can be made as a slot in segment 21 forming the collection port that faces the abrasive disk 3. In the preferred embodiment illustrated in FIG. 3, the lower portion of this slot is tangent to the inner diameter of the ceramic tube 24 forming the cladding of the means for reflecting and absorbing the kinetic and thermal energy, and may moreover be oriented slightly upward in order to be adapted to the shape of the spark jet 40. This jet is essentially cone-shaped, hence the height of the entrance 22 or of said slot must be sufficiently large in order to recover almost all of the spark jet. When the abrading unit 2 includes several abrasive disks 3, the waste pickup 20 may have several separate segments 21 each forming a collection port facing one disk 3, or the slot may simply be sufficiently long so as to serve as the entrance 22 for all abrasive disks 3.

Once the particles of the spark jet have been gathered up by the collection port 21 without forming agglomerations on its inner walls, by having lost a sufficiently large part of their energy, they may preferably be sucked up through an exit 23. In the example shown in the figures, its position is such that the waste is carried away toward the top.

To this end a connecting piece 28 is attached to exit 23. This piece 28 may again have a rounded cross section, preferably oval, so that on the one hand one can realize a relatively narrow exit and raise the surface area of collection port 21 that is available for impact of the arriving sparks, and on the other hand create a transition without edges between the segment 21 forming the collection port and the connecting piece 28, as well as between this piece and a hose forming a channel 29 for evacuating the waste toward a container on the railroad vehicle. The railroad vehicle or container in addition include appropriate filters as well as means for diminishing the pressure in the segment 21 forming a collection port, means that are connected with segment 21 by the connecting piece 28 and the channel 29. The abrasive waste and the glowing chips in particular that are the main constituents of spark jet 40 are thus sucked up, deflected, and transported from the collection port to the container where they are preliminarily kept until they are discharged.

In another embodiment not shown in the figures it is conceivable to realize the means for waste transport as mechanical means, rather than having a suction conveyor that requires means for evacuation. In this case exit 23 would be arranged beneath waste pickup 20, so that the particles of the spark jet captured without forming agglomerations in segment 21 forming the collection port drop under the effect of gravity and are transported toward the container, for instance with a belt conveyor or other, equivalent mechanical means. This shows that it is essential that the device according to the present invention comprise a waste pickup 20 having a surface adapted to take up the particles of the spark jet 40 without the formation of agglomerations on this surface, and that this pickup 20 cooperate with the means for transporting the waste so that it can be eliminated.

Figure 4:
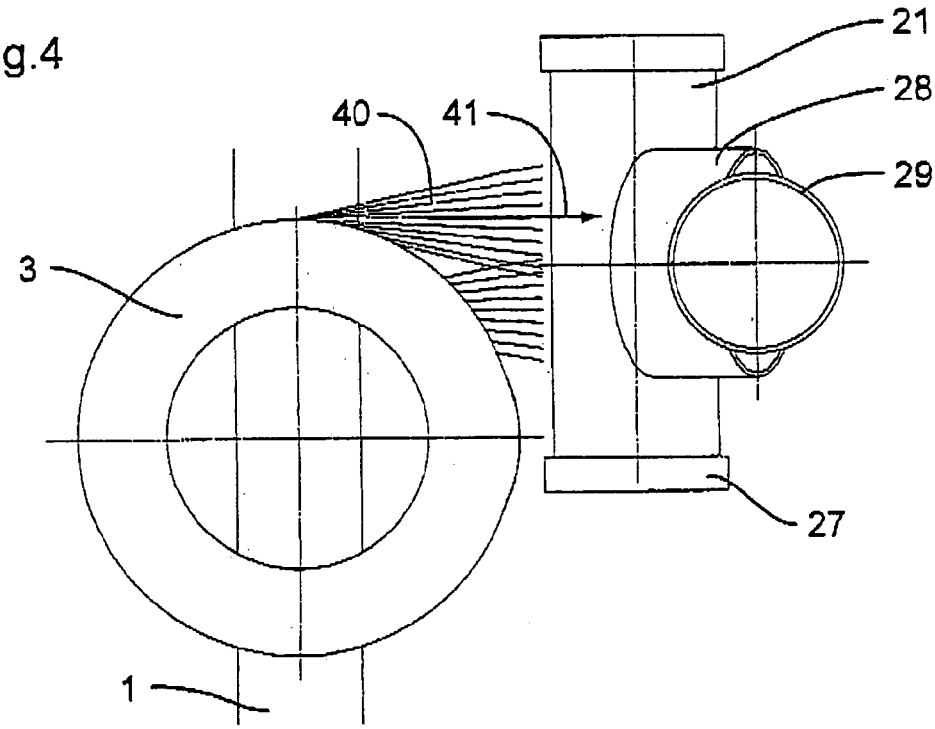
FIG. 4 is a schematic top view, partly sectioned, of an abrasive disk with the abrasive-waste pickup mounted so as to face it.

Coming back to the means for reflecting and absorbing the kinetic and thermal energy, it should be noted that they preferably include, not only a specific material and shape but also other measures inhibiting an adhesion of the material within pickup 20. In addition, they preferably comprise a device for cooling at least part of the inner walls of waste pickup 20, and particularly of the segment 21 forming the collection port. This cooling device may notably include a water and/or air cooling as shown by way of example in FIG. 3. Here the ceramic tube 24 and the inner walls of segment 21 forming a collection port are cooled with water via several cross channels fed by lateral flanges on each side of segment 21 or tube 24, as schematically shown in FIG. 4.

The means for reflecting and absorbing the kinetic and thermal energy may also include air and/or water nozzles. These nozzles normally are located in the lateral flanges 27, and can be used on the one hand to sprinkle water onto the spark jet, so as to lower the energy of the jet particles by water evaporation and cool the spark jet. The energy of the glowing metal particles may thus be sufficiently reduced, which effectively contributes to the avoidance of their agglomeration on segment 21 forming the collection port. These nozzles on the other hand may serve to produce an irregular air flow in the interior of this segment 21, and particularly in the zone impacted by the spark jet, which again contributes to the effects inhibiting waste deposition within segment 21.

The means for reflecting and absorbing the kinetic and thermal energy finally may include a vibrating device 50 making it easier to detach and suck up the material accumulated on the inner walls of the waste pickup. Thus, vibrators may be provided on pickup 20, and particularly on segment 21, in order to facilitate detachment of the nuclei for the agglomeration of matter that may have formed despite the other measures already mentioned.

It is obvious that one skilled in the art would know how to apply these principles to any abrading unit 2 having, either several abrasive disks 3 or a waste pickup 20 of different shape, for instance with separate collection ports 21 for each disk 3 or with a single large port 21 for several abrasive disks.

As already mentioned hereinabove, the abrasive waste pickup 20—like the abrading unit 2 with disk 3—is mounted on rack 5 in such a way that the segment 21 forming a collection port that is set up so as to face the abrasive disk 3 would follow the movements of the abrading unit 2 that are needed for optimum rail rectification results. It is advantageous, however, to provide for the possibility that the height of the waste pickup 20 could be varied relative to the abrasive disk 3 on the abrading unit 2, as a function of inclination of disk 3 and of the working conditions for the reprofiling of rail 1.

Figure 5:
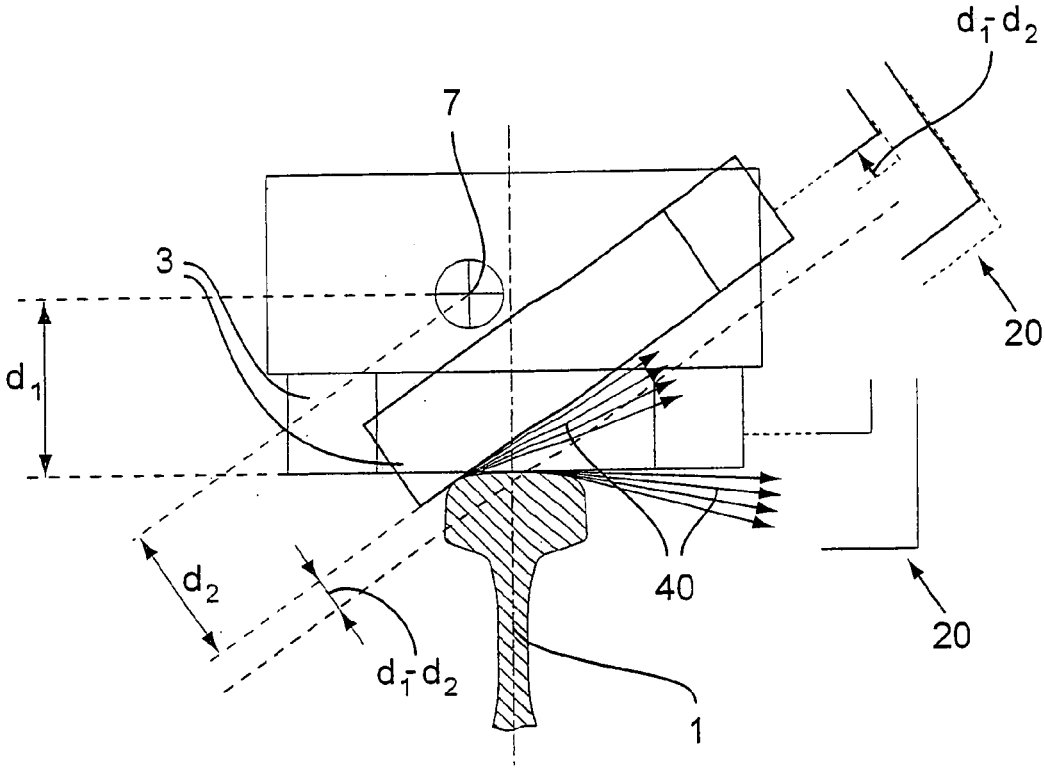
FIG. 5 schematically illustrates the height of the abrasive disk and of the spark jet generated, relative to the abrasive-waste pickup as a function of inclination of the abrasive disk.

It is often the case in rail reprofiling devices of railroads, in fact, that the swivel point or axis of rotation 7 of the abrasive disk 3 is above rail 1, as schematically illustrated in FIG. 5. This axis of rotation 7 normally is fixed relative to rail 1, which implies that the controls which provide a sufficiently large force pressing disk 3 against rail 1 must withdraw disk 3 upward when disk 3 is tilted so as to work on another surface segment of rail 1. The vertical distance $d_1$ or $d_2$ between the plane of contact between disk 3 and rail 1 and the axis of rotation 7 of rack 5 will then vary as a function of inclination of the abrasive disk 3. Since the waste pickup 20 is also mounted on rack 5, withdrawal of the abrasive disk 3 by the controls will cause a slight relative movement of disk 3 relative to pickup 20, and particularly its segment 21 forming a collection port. The waste pickup 20 in order to be able to adapt to this variation is mounted in such a way on the rack 5 that it may assume different heights relative to the axis of rotation 7 of rack 5. To this end the pickup 20 is mounted on a linear guide 30 incorporating a jack 31. Jack 31 or pickup 20 can then be adjusted in their height, for example with the aid of a system of hinged latches 32 or any other means providing this function. Preferably each angle of inclination of the abrasive disk 3 is associated with a particular height of the corresponding waste pickup 20. Normally this is done in discrete steps, that is, the entire spread of angles of inclination of disk 3 is distributed over a certain number of positions in height available for pickup 20, in order to reduce the number of required positions and facilitate construction of the device. FIG. 5 schematically shows how the pickup 20 is raised by a distance $d_1$- $d_2$ following the tilting of disk 3 required to work on another surface part of rail 1.

In a general way, therefore, the geometric axis of the major waste jet produced during operation of this abrasive disk 3 essentially falls always into the geometric center of entrance 22 of this collection port 21, since the segment 21 forming a collection port of an abrasive-waste pickup 20 can be oriented as a function of position of an abrasive disk of the reprofiling unit. In the embodiment illustrated in the figures, the segment 21 forming a collection port of an abrasive-waste pickup is adjustable, particularly in a direction normal to the plane of the rails 1 of the railroad tracks. By the same principle, it could as well be adjusted in a direction horizontally along the rail 1.

Figure 6:
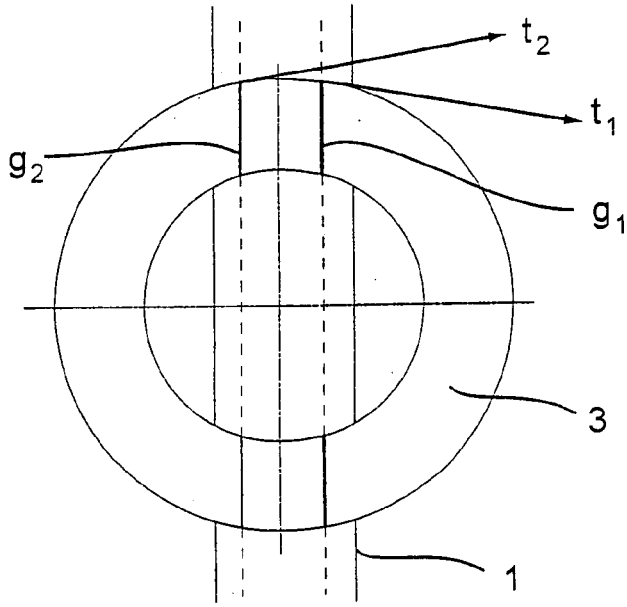
FIG. 6 schematically shows the horizontal direction of the spark jet relative to the abrasive-waste pickup as a function of position of the abrasive disk on the rail.

Another possibility to ensure optimum efficiency of the device with respect to the amount of waste transported away consists in manipulating the geometric axis 41 of the major waste jet 40 produced during operation of an abrasive disk 3 in a reprofiling unit 2. This geometric axis 41 may actually be oriented during operation of the device in such a way that this axis 41 of the jet 40 always essentially falls into the geometric center of a segment 21 forming a collection port of an abrasive-waste pickup 20. This configuration is schematically represented in FIG. 6. Normally the abrasive surface of a disk 3 is in contact with the surface of rail 1 along a generatrix $g_1$ or $g_2$. The geometric axis of the corresponding spark jet is simply the tangent $t_1$ or $t_2$ to the circumference of disk 3 at the point of intersection between the circumference and the generatrix concerned. The good lateral positioning of abrasive disk 3 relative to rail 1 which is achieved as a function of inclination of disk 3 may then be used for controlling the direction of the spark jet 40 toward the waste pickup 20, particularly so in a horizontal plane, so as to collect a maximum of the waste and thus raise the efficiency of the device.

It is for this reason that the plates 8 are fastened between support 11 and rack 5 by the spring blades 9 that had been mentioned earlier. Rack 5 holding the abrading unit 2 may thus be displaced with the aid of jack 10 in a direction that is essentially orthogonal to the direction of rails 1, as can be taken from FIG. 1. The jacks 10 for example are equipped with a measuring system housed in their pillars so as to set the required position of rack 5. While laterally moving the abrading unit 2 closer to or farther away from rails 1, and adjusting the height of the abrasive disk 3 through its controls or by a tilting of disk 3, the line of contact between disk 3 and rail 1, and thus the direction of spark jet 40, may be manipulated in such a way that the jet falls essentially into the geometric center of the entrance 22 of segment 21 forming a collection port. The geometric axis 41 of this jet 40 coming from an abrasive disk 3 may then be adjusted by a displacement of this disk, which allows the spark jet 40 to be directed in a wanted direction. The lateral positioning of disk 3 that occurs in order to adjust the direction of the spark jet 40, to the contrary, does not detract from the quality of rail rectification, since still the same specific surface segment of rail 1 is abraded, even if along another generatrix and thus a different geometry.

The two possibilities described above, for enhancing the efficiency of the device with respect to the quantity of waste transported away have to do, in an abstract way, with the relative positions of an abrasive disk 3 of a reprofiling unit 2 and of the collection port 21 of an abrasive-waste pickup 20. These relative positions must be variable in order to achieve this aim, in such a way that the geometric axis 41 of the major waste jet 40 produced during operation of the abrasive disk 3 will always fall, essentially into the geometric center of entrance 22 of the corresponding collection port 21. This aim can be achieved, not only by the measures presented hereinabove or their combination but by any other measure having the same effect. For example, the segment 21 forming a collection port could be realized in another embodiment as a mobile head allowing its entrance to be oriented toward the spark jet.

It should also be noted that notably the vertical displacement of the waste pickup 20 along linear guide 30 by jack 31 is equally useful when an obstacle on the rails must be circumvented, for instance by momentarily lifting the pickup by a vertical movement.

The detailed description given above shows that by the measures taken in a reprofiling device according to the present invention one obtains more particularly the elimination of the heavy particles included in the spark jet that is taken up, deflected, and then transported to a container for proper disposal of the abrasive waste. Thus, an elimination of almost all the abrasive waste generated by the rectification of the rails of railroads by abrasion becomes possible, and the environmental compatibility of rail rectification is improved. With the spark jet, the source of danger that it represents for the staff in charge of the reprofiling device is eliminated at the same time. By the way, components of the device other than the abrasive disk and the waste pickup are much less stressed thermally, which prolongs their lifetime.

The invention claimed is:

1. Device for the continuous reprofiling of rails (1) of railroad tracks, including at least one abrasive rail reprofiling unit (2) guided along a railroad track and comprising at least one abrasive disk (3) that can be pressed against the rails (1), wherein operation of said abrasive disk (3) produces a major waste jet (40) having a geometric axis (41), characterized in that said device includes at least one abrasive-waste pickup (20) comprising at least one segment forming a collection port (21) having a geometric center, said segment being placed in the immediate vicinity of at least one abrasive disk (3) and into the geometric axis (41) of the major waste jet (40) produced during operation of this abrasive disk (3), and in that the relative positions of said abrasive disk (3) of said reprofiling unit (2) and said collection port (21) of said abrasive-waste pickup (20) are variable in such a way that the geometric axis (41) of said major waste jet (40) essentially falls into the geometric center of the corresponding collection port (21).

2. Device according to claim 1, characterized in that each waste pickup (20) comprises means for reflecting and absorbing the kinetic and thermal energy, allowing the formation of agglomerations of matter on said pickup to be avoided.

3. Device according to claim 2, characterized in that the means for reflecting and absorbing the kinetic and thermal energy comprise a cladding (24) of at least one part of the inner walls of the waste pickup (20) with a material adapted to avoid the formation of agglomerations of matter on its surface.

4. Device according to claim 3, characterized in that the material is a ceramic material.

5. Device according to claim 2, characterized in that the means for reflecting and absorbing the kinetic and thermal energy comprise at least one segment having a smooth shape adapted to avoid the formation of agglomerations of matter on its surface.

6. Device according to claim 2, characterized in that the means for reflecting and absorbing the kinetic and thermal energy comprise a device for cooling at least one part of the inner walls of the waste pickup.

7. Device according to claim 6, characterized in that the device for cooling comprises a cooling by water (26).

8. Device according to claim 2, characterized in that the means for reflecting and absorbing the kinetic and thermal energy comprise air nozzles.

9. Device according to claim 2, characterized in that the means for reflecting and absorbing the kinetic and thermal energy comprise a vibrating device (50) facilitating the detachment and conveying of accumulations of matter on the inner walls of the waste pickup.

10. Device according to claim 2, characterized in that the means for reflecting and absorbing the kinetic and thermal energy comprise at least one segment having a curved cross section adapted to avoid the formation of agglomerations of matter on its surface.

11. Device according to claim 2, characterized in that the means for reflecting and absorbing the kinetic and thermal energy comprise air water nozzles.

12. Device according to claim 1, characterized in that the segment forming a collection port (21) of an abrasive-waste pickup (20) can be oriented as a function of the position of an abrasive disk (3) of a reprofiling unit (2) in such a way that the geometric axis (41) of the major waste jet (40) produced during operation of this abrasive disk (3) essentially falls into the geometric center of said collection port (21).

13. Device according to claim 1, characterized in that the segment forming a collection port (21) of an abrasive-waste pickup (20) can be adjusted in a direction vertical with respect to the plane of the rails (1).

14. Device according to claim 1, characterized in that the geometric axis (41) of the major waste jet (40) produced during operation of an abrasive disk (3) of a reprofiling unit (2) can be oriented in such a way that the geometric axis (41) of this jet essentially falls into the geometric center of a segment forming a collection port (21) of an abrasive-waste pickup (20).

15. Device according to claim 1, characterized in that the geometric axis (41) of said jet (40) coming from an abrasive disk (3) can be adjusted by displacing this disk (3).

* * * * *